US009457597B2

(12) United States Patent
Jiang

(10) Patent No.: US 9,457,597 B2
(45) Date of Patent: Oct. 4, 2016

(54) PRINTER AND BLADE WITHDRAWAL MECHANISM THEREOF

(75) Inventor: Duoyong Jiang, Shenzhen (CN)

(73) Assignee: Shenzhen Zhengtong Electronics Co., Ltd., Shenzen (CN)

( * ) Notice: Subject to any disclaimer, the term of this patent is extended or adjusted under 35 U.S.C. 154(b) by 35 days.

(21) Appl. No.: 14/345,730

(22) PCT Filed: Mar. 29, 2012

(86) PCT No.: PCT/CN2012/073269

§ 371 (c)(1),
(2), (4) Date: Mar. 19, 2014

(87) PCT Pub. No.: WO2013/040882

PCT Pub. Date: Mar. 28, 2013

(65) Prior Publication Data

US 2014/0224092 A1 Aug. 14, 2014

(30) Foreign Application Priority Data

Sep. 19, 2011 (CN) ..... 2011 1 0280593

(51) Int. Cl.

| | |
|---|---|
| ***B41J 11/70*** | (2006.01) |
| ***B41J 11/66*** | (2006.01) |
| ***B26D 1/06*** | (2006.01) |
| ***B26D 7/00*** | (2006.01) |
| ***B26D 7/22*** | (2006.01) |
| *B26D 1/08* | (2006.01) |
| *B26D 7/26* | (2006.01) |

(52) U.S. Cl.

CPC ..... *B41J 11/706* (2013.01); *B26D 7/00* (2013.01); *B26D 7/22* (2013.01); *B26D 1/085* (2013.01); *B26D 7/2614* (2013.01); *B26D 2007/005* (2013.01); *Y10T 83/9488* (2015.04)

(58) Field of Classification Search

CPC .. B26D 1/085; B26D 2007/005; B26D 7/00; B26D 7/22; B26D 7/2614; B41J 11/706; Y10T 83/9488

See application file for complete search history.

(56) References Cited

U.S. PATENT DOCUMENTS

| | | | | |
|---|---|---|---|---|
| 2006/0230956 | A1* | 10/2006 | Yoshioka | B26D 7/24 101/226 |
| 2009/0279935 | A1 | 11/2009 | Kawaguchi | |
| 2009/0317163 | A1* | 12/2009 | Kohira | B26D 1/085 400/621 |

FOREIGN PATENT DOCUMENTS

| | | |
|---|---|---|
| CN | 1775543 | 5/2006 |
| CN | 101607487 | 12/2009 |
| CN | 201677574 | 12/2010 |
| EP | 1 955 833 | 8/2008 |
| WO | WO 03/064163 | 8/2003 |

OTHER PUBLICATIONS

Search Report from PCT/CN2012/073269, dated Jul. 5, 2012.

* cited by examiner

*Primary Examiner* — Stephen Choi

(74) *Attorney, Agent, or Firm* — Westman, Champlin & Koehler, P.A.

(57) ABSTRACT

A printer and its blade withdrawal mechanism, comprising: a fixing board, used for fixing a down cutter, the lower end of the fixing board can be pivotally installed on an installing support; a balance unit; a locking unit; and a manipulation unit, which is installed on the installing support, located at one side of the combination of the fixing board and the down-cut blade, and can move downward by two segment travels under the effect of external force, at the first segment travel, it can act on the balance unit, while at the second segment travel, it can act on the locking unit. The invention can simplify the handling of the faults such as paper jam, and improve the handling efficiency.

8 Claims, 7 Drawing Sheets

PRINTER AND BLADE WITHDRAWAL MECHANISM THEREOF

CROSS-REFERENCE TO RELATED APPLICATION

This Application is a Section 371 National Stage Application of International Application No. PCT/CN2012/073269, filed Mar. 29, 2012 and published as WO 2013/040882 on Mar. 28, 2013, not in English, the contents of which are hereby incorporated by reference in their entirety.

TECHNICAL FIELD

The invention relates to a printer, especially blade withdrawal mechanism of the printer.

BACKGROUND ART

The printers of the prior art are generally installed with automatic cutting paper device, which generally consists of the mutually cooperated top-cut blade part and down cut-blade blade part, thereof, the top cut-cut blade part further comprises the top-cut blade which can move up and down, and the drive unit comprising motor, worm and cam mechanism. While the down-cut blade part comprises the fixed installed down-cut blade, paper cutting unit and installing support, where both the down-cut blade and the paper cutting unit are installed on the installing support. The installing support itself can be pivotally installed on the mainframe of the printer. Under normal operation condition, when paper is required to be cut after being printed, program operated in the controller of the printer will send instruction to the drive unit of the top-cut blade part, enabling the top-cut blade to move downward to the setting position where paper can be cut off, then return to the home position automatically. If for some reason, for example: paper is stuck between the top-cut blade and the down-cut blade, enabling the top-cut blade fails to return automatically, then the top-cut blade will be partially blocked at the outside of the down-cut blade, enabling the maintenance personnel fails to directly open the down-cut blade part. On the other hand, for protection need, under the circumstance that the top-cut blade fails to return to the home position due to being jammed, after the passing of the set homing time or in the case of detecting abnormal motor operation, the controller will cut off power source of the motor, so as to avoid motor burnout. At this time, blade withdrawal mechanism is needed, and manual intervention is required, so as to shoot the trouble. For the blade withdrawal mechanism of the prior art, it is just the setting of a window simply at the top-cut blade part to enable the worm to expose partially, thus maintenance personnel can poke the worm manually, drive the top-cut blade to return to the home position artificially, and clear paper and conduct other maintenance work by opening the down-cut blade part after the return of the top-cut blade. However, such structure wastes time and energy at handling troubles such as paper jam, and the efficiency is low. Therefore, it is indeed necessary to improve the prior art.

CONTENT OF THE INVENTION

The invention is intended to solve the technical issues by means of avoiding the deficiencies of the above the prior art, and put forward a printer and its blade withdrawal mechanism, which can simplify the handling of faults such as paper jam and improve the handling efficiency.

Technical proposal adopted by the invention for solving the above technical issues includes putting forward a blade withdrawal mechanism of a printer, comprising:

a fixing board, used for fixing a down-cut blade, the lower end of the fixing board can be pivotally installed on an installing support, and lower end of the installing support can be pivotally installed on a main body;

a balance unit, installed on the installing support, and acts on the combination of the fixing board and the down-cut blade from front and rear, so as to enable the combination to be at the non-pivotal normal state, or at the blade withdrawal state of pivotally rotating to the rear by a certain angle;

a locking unit, used for enabling the installing support to be at a locking state of being connected to the main body non-pivotally, or at an open state of pivotally rotating to the front by certain angle forward; and a manipulation unit, installed on the installing support and located at one side of the combination of the fixing board and the down-cut blade, can move downward by two segment travels under the effect of an external force, at the first segment travel, it can act on the balance unit, so as to enable the combination of the fixing board and the down-cut blade to convert from the normal state to the blade withdrawal state, while at the second segment travel, it can act on the locking unit, so as to enable the installing support to convert from locking state to open state.

The manipulation unit comprises a position induction switch which is located at the border between the first segment travel and the second segment travel.

The manipulation unit comprises a main part which can move downward under the effect of external force, and a flexible assembly which can enable the main part to maintain/return to top position; the main part is set with a handle, a first matching part for cooperating the balance unit, and a second matching part for cooperating the locking unit.

The first matching part of the manipulation unit comprises a vertically extended chute which is set at the upside of the main part, and a first stop dog. The second matching part comprises a second stop dog which is set under the first stop dog.

The balance unit comprises a camshaft which is set in the rear resisting against the combination of the fixing board and the down-cut blade, and a cam which is installed at the end of the camshaft. The cam is provided with a pivoting head, and the balance unit cooperates with the manipulation unit through the cam.

The balance unit also comprises a flexible assembly which is set in the front for resisting and pushing backward the combination of the fixing board and the down-cut blade.

The balance unit further comprises a stop block which is set at the rear of the combination of the fixing board and the down-cut blade, for limiting the rotation angle of the camshaft.

The camshaft is a cylinder with smooth cutting face, and the cutting face of the camshaft is perpendicular to the combination of the fixing board and the down-cut blade when the latter is at normal state.

The locking unit comprises a slip sheet which is installed on the installing support and can move downward under the effect of external force, a flexible assembly which can enable the slip sheet to maintain/return to the top position, and a stop dog which is installed on the main body and cooperates with the slip sheet. The slip sheet is provided with a chute and a bonding jumper, and the locking unit cooperates with the manipulation unit through the slip sheet and the bonding jumper.

Technical proposal adopted by the invention for solving the above technical issues further includes putting forward a printer, comprising the aforementioned blade withdrawal mechanism.

Compared with the prior art, by setting mutually cooperated balance unit, locking unit and manipulation unit of two segment travels, printer of the invention and its blade withdrawal mechanism can successively complete the action of getting rid of the jamming between the top-cut blade and down-cut blade and the action of opening the down-cut blade part automatically in one go without interruption, which can greatly simplify the handling of faults such as paper jam, and improve the processing efficiency.

MODE OF CARRYING OUT THE INVENTION MODEL

To further illustrate the principle and structure of the invention, the invention is further described in detail in accordance with the preferable embodiments shown in the figures.

Figure 1:
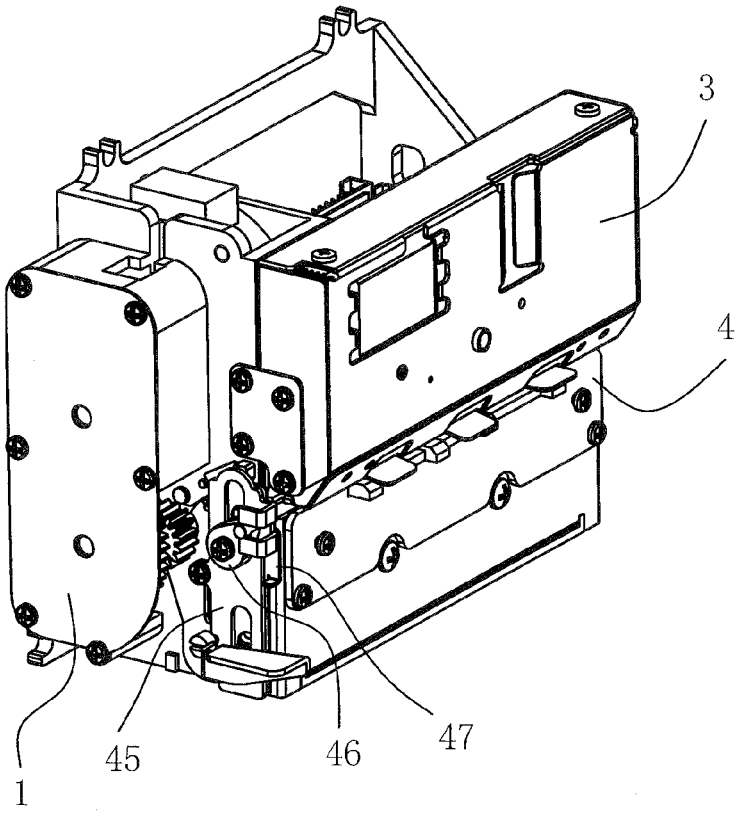
FIG. 1 is the stereogram of the printer embodiment of the invention.
Figure 2:
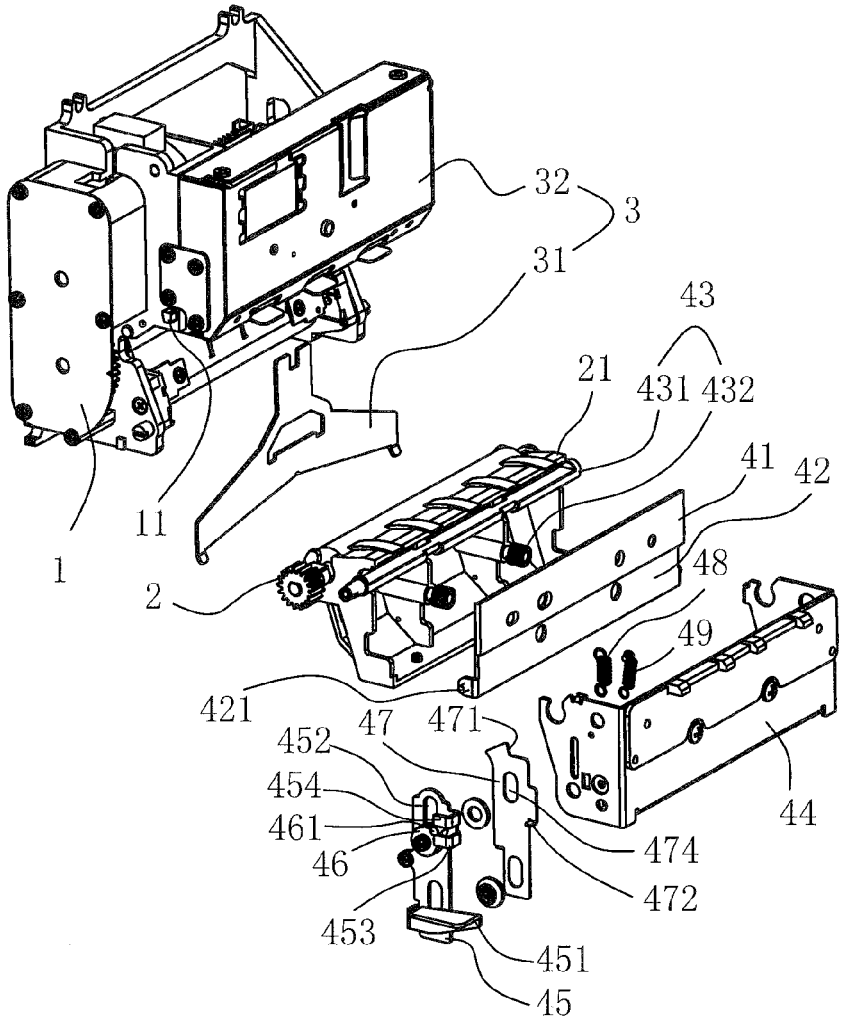
FIG. 2 is the 3D exploded view of the printer embodiment of the invention.
Figure 3:
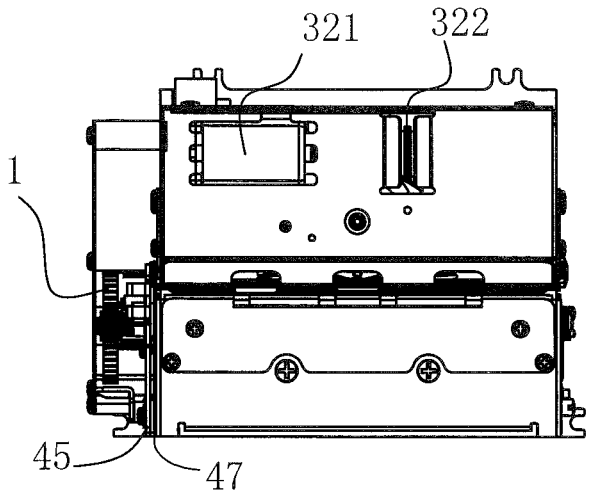
FIG. 3 is the front view of the printer embodiment of the invention.
Figure 4:
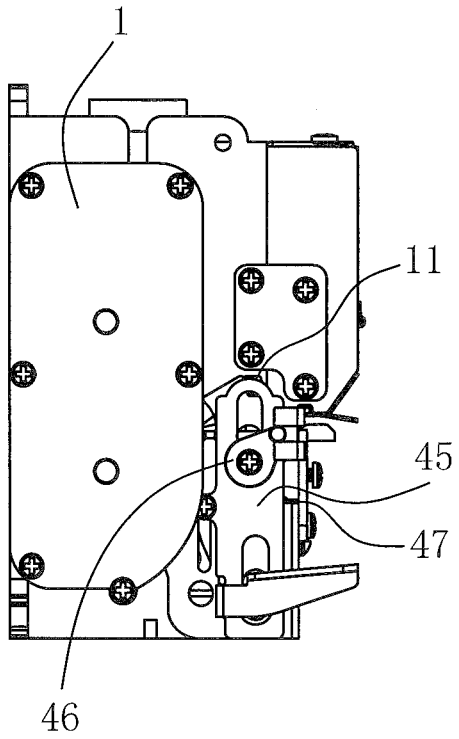
FIG. 4 is the left view of the printer embodiment of the invention when the printer is at normal or fault state.

See FIG. 1, FIG. 2 and FIG. 3, printer embodiment of the invention roughly comprises: main body 1, top-cut blade part 3 and down-cut blade part 4.

Figure 5:
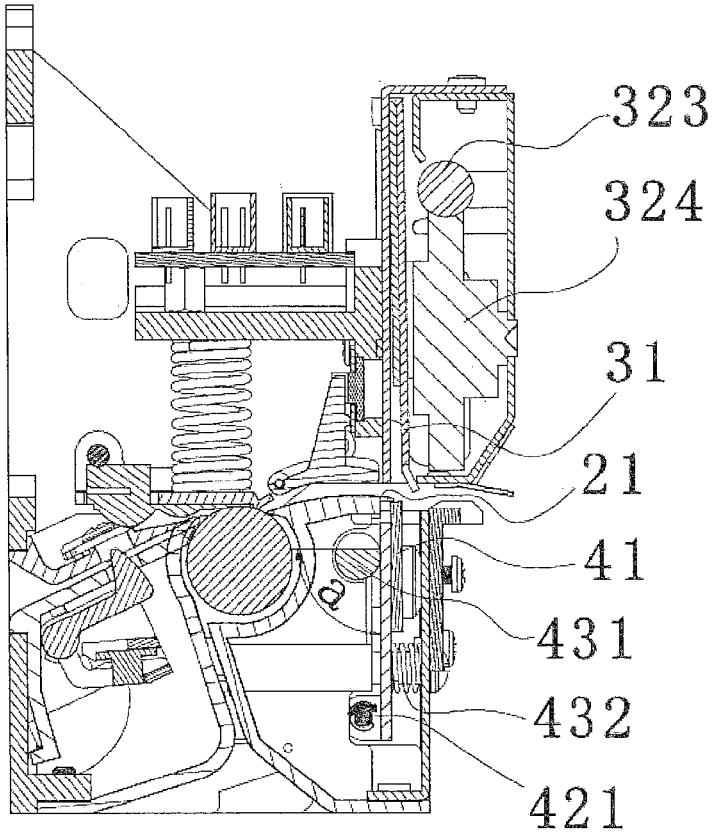
FIG. 5 is the sectional view of the printer embodiment of the invention when the printer is at normal state.
Figure 6:
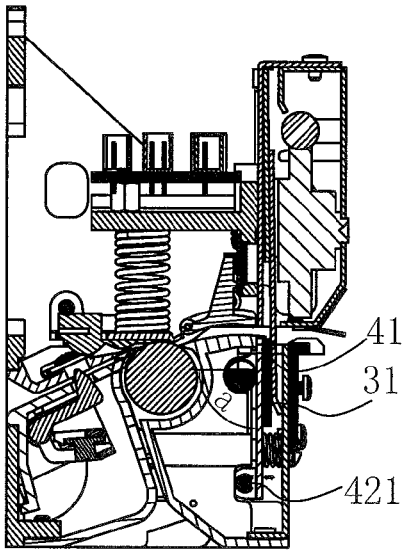
FIG. 6 is the sectional view of the printer embodiment of the invention when the printer is at fault state.
Figure 7:
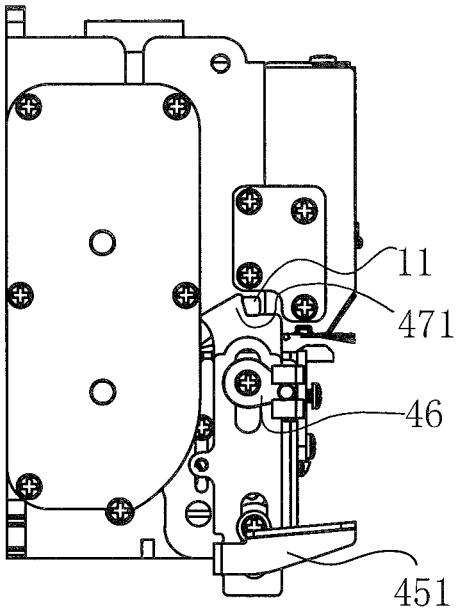
FIG. 7 is the left view of the printer embodiment of the invention when the manipulation unit has traveled the first segment travel.
Figure 8:
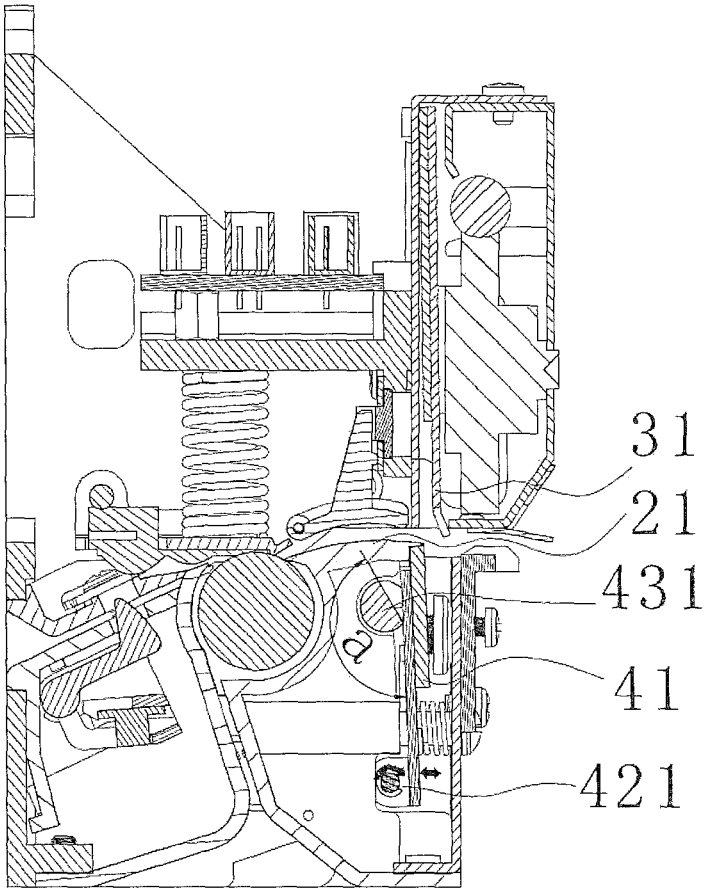
FIG. 8 is the sectional view of the printer embodiment of the invention when the manipulation unit has traveled the first segment travel.
Figure 9:
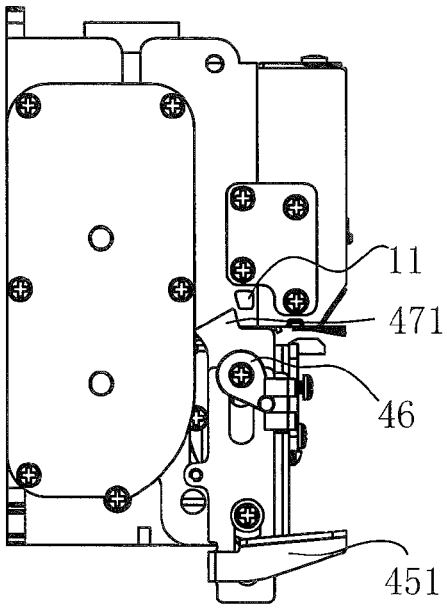
FIG. 9 is the left view of the printer embodiment of the invention when the manipulation unit has traveled the second segment travel.
Figure 10:
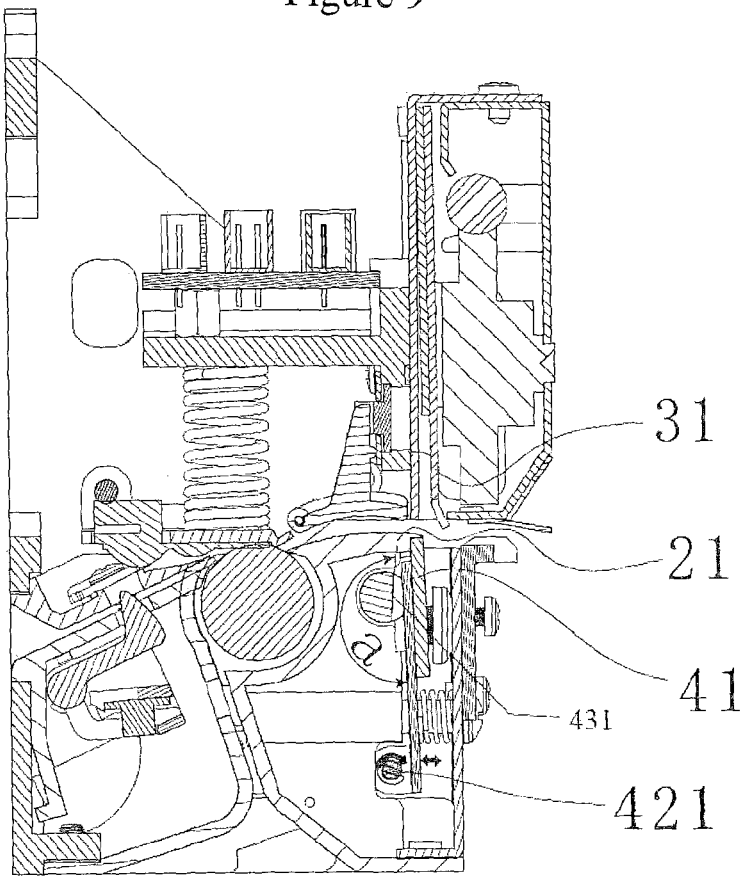
FIG. 10 is the sectional view of the printer embodiment of the invention when the manipulation unit has traveled the second segment travel.
Figure 11:
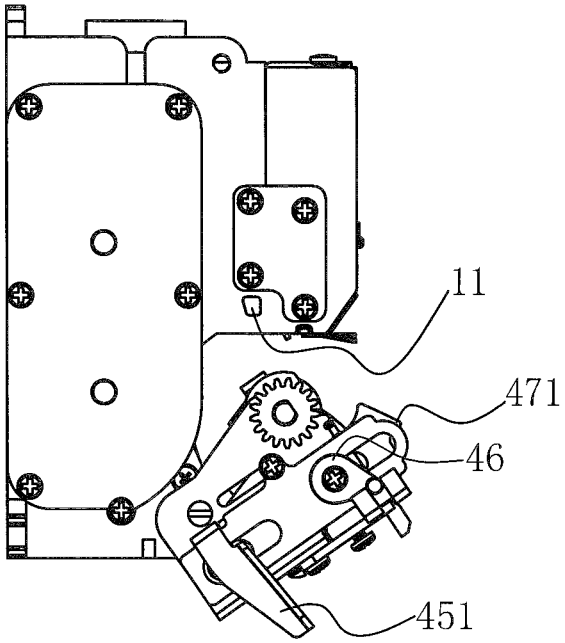
FIG. 11 is the left view of the printer embodiment of the invention when the installing support is at open state.
Figure 12:
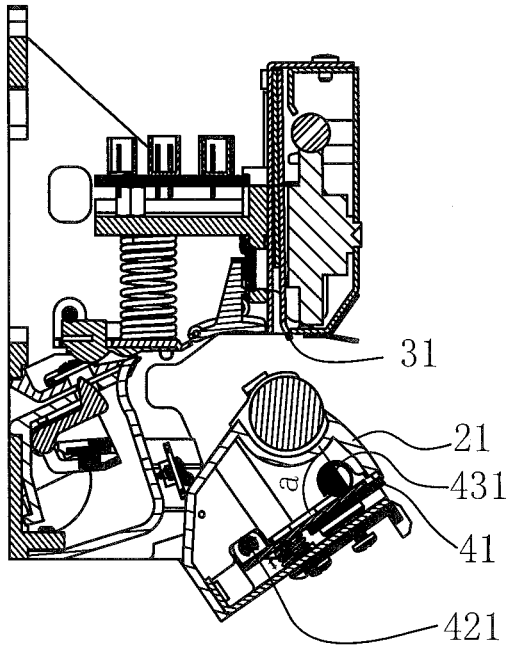
FIG. 12 is the sectional view of the printer embodiment of the invention when the installing support is at open state.

The top-cut blade part 3 comprises the top-cut blade 31 and the drive unit 32. See FIG. 5, the drive unit is composed of motor 321, dial wheel 322, worm 323 and cam mechanism 324. The dial wheel 322 is connected with the worm 323 as a whole, worm 323 can be driven by the dial wheel 322 while the latter is poked artificially, thus enabling the cam mechanism 324 to drive the top-cut blade 31 installed thereupon to move up and down.

The down-cut blade part 4 comprises the down-cut blade 41, the paper cutting unit 2, the installing support 44 and the blade withdrawal mechanism. In the embodiment, the installing support 44 is the plate sealing component. The blade withdrawal mechanism comprises:

A fixing board 42, used for fixing a down-cut blade 41, the lower end of the fixing board 42 is set with pivot 421 which can be pivotally installed on the installing support 44, while the lower end of the installing support 44 can be pivotally installed on the main body 1.

A balance unit 43, which is installed on the installing support 44 and acts on the combination of the fixing board 42 and the down-cut blade 41 from front and rear, so as to enable the combination to be at non-pivotal normal state, or blade withdrawal state of pivotally rotating to the rear by certain angle. It comprises: a camshaft 431, which is a cylinder with smooth cutting face, see FIG. 5, set at the rear of the combination of the fixing board 42 and the down-cut blade 41 for resisting the combination, included angle a between the cutting face of the camshaft 431 and the combination of the fixing board 42 and the down-cut blade 41 when the combination is at normal state is 90°; a cam 46 which is installed at the end of the camshaft 431 and provided with a pivoting head 461; flexible assembly 432 which is set at the front of the fixing board 42 and the down-cut blade 41, for resisting and pushing backward the combination of the fixing board 42 and the down-cut blade 41, in the embodiment, the flexible assembly 432 can be two compressed springs, while in the other embodiment, the flexible assembly 432 can also be several tension springs set at the rear of the fixing board 42 and the down-cut blade 41 for connection and pulling back the combination of the fixing board 42 and the down-cut blade 41; a stop block 21, which is set at the rear of the combination of the fixing board 42 and the down-cut blade 41, for limiting the rotation angle of the camshaft 431, and in the embodiment, limiting of the stop block 21 is achieved through the paper cutting board in the paper cutting unit 2.

A locking unit, which is for enabling the installing support 44 to be at the locking state of connecting with the main body 1 non-pivotally or at the open state of pivoting forward by certain angle, and it comprises a slip sheet 47 which is installed on the installing support 44 and can move downward under the action of external force, a flexible assembly 49 which can enable the slip sheet 47 to maintain/return to the top position and a stop dog 11 which is installed on the main body 1 and cooperates with the slip sheet 47, and the slip sheet 47 is set with a chute 474 and a bonding jumper 472; and A manipulation unit, which is installed on the installing support 44, located at one side of the combination of the fixing board 42 and the down-cut blade 41, and move downward by two segment travels under the action of external force. See FIG. 4 to FIG. 8, at the segment travel, it can act on the balance unit, so as to enable the combination of the fixing board 42 and the down-cut blade 41 to convert from normal state to blade withdrawal state; see FIG. 9 to FIG. 12, at the second segment travel, it can act on the locking unit, so as to enable the installing support 44 to convert from locking state to open state. It comprises a position induction switch (has not been shown by Figure) which is set between the border of the first segment travel and second segment travel, the position induction switch can inform the processor in the printer, enabling the processor to control the operation of the motor 321 of the top cutter part 3, so as to enable the top-cut blade 31 to return to the home position automatically, generally, time spent by the return process is within 1 Second, which is extremely rapid. The manipulation unit comprises a main part 45 which can move downward under the action of external force and a flexible assembly 48 which can enable the main body to maintain/return to the top position; the main part 45 is set with a handle 451, a first matching part for cooperating the balancing unit, and a second matching part for cooperating the locking unit. The first matching part comprises a vertically extended chute 452 which is set at the upside of the main part 45 and a first stop dog 454, pivoting head 461 of the cam 46 is resisted below the first stop dog 454, so as to enable the cam 46 to move in the chute 452 and drive the camshaft 431 to rotate; the second matching part comprises a second stop dog 453 which is set below the first stop dog 454, the second stop dog 453 can connect against the bonding jumper 472 on the slip sheet 47, while the slip sheet 47 to move downward during the second segment travel, till the upper end 471 of the slip sheet 47 will be no longer limited by the stop dog 11.

Operating principle of the printer and its blade withdrawing mechanism of the invention roughly comprises: when the printer is at normal state, action of the tension spring 48 of the handle 451 is at the highest point, action of the tension spring 49 of the slip sheet 47 is at the highest point, cam 46 is at the highest point, contact angle between the cutting face of the camshaft 431 and the fixing board 42 a is 90°, and the spring 432 imposes backward force to the fixing board 42 and the down-cut blade 41.

When during paper cutting process, the top-cut blade 31 of the printer fails to return due to the friction effect of paper, namely paper jam, to avoid motor burnout, motor 321 stops running, and corresponding detection switch will inform the processor to cut off the motor power source after a certain time, so as to enable the motor to stop working. At this time, maintenance personnel can press downward the handle 451, during the first segment travel downward, the handle 451 will drive the cam 46, the cam 46 will drive the camshaft to 431 rotate by certain angle, and under the action of the spring 432, fixing board 42 and down-cut blade 41 will also rotate by a corresponding angle, at this time, see FIG. 7 and FIG. 8, contact angle a between the cutting face of the camshaft 431 and the fixing board 42 is 150°, the top-cut blade 31 and down-cut blade 41 will maintain certain distance from front and rear, the position induction switch will inform the process to control the motor 321 to return to work, the motor 321 will drive the worm 323 to rotate, the worm 323 will drive the cam mechanism 324 to move, so as to drive the top cutter 31 to return to the home position, meanwhile, rear of the down-cut blade 41 will be blocked by the stop block 21, limited by the stop dog 11, upside 471 of the slip sheet 47 will enable the down-cut blade part 4 fails to open. Then, maintenance personnel can continue to press down the handle 451, during the second segment travel traveled by the handle 451, the second stop dog 453 and the bonding jumper 472 on the slip sheet 47 connect and cooperate against each other, which can drive the slip sheet 47 to move downward, meanwhile, camshaft 431 can continue to move, see FIG. 10, nevertheless, because rear of the down-cut blade 41 is blocked by the stop block 21, the down-cut blade 41 will not continue to rotate, till the completion of the second stroke, at this time, stop block 11 fails to block the upper end 471 of the slip sheet 47, down-cut blade part 4 can open outward, so as to conduct maintenance work such as removing paper scrap, till the completion of clearing, then enable the down-cut blade part 4 to return to the locking state, and the printer can be put into operation again.

In case of damage of the position induction switch, motor 321, or drive circuit of the motor 321, giving rise to the completion of the above first segment travel, failure of self-return of the top-cut blade 31, maintenance personnel shall manually enable the top-cut blade 31 to return relying on the dial wheel 322, then press down the handle 451 to complete the second segment travel, so as to implement corresponding maintenance work.

The above embodiment is only the preferred embodiment of the invention, aiming to further explain the invention, rather than limiting. Simple replacements in accordance with the content disclosed by the above test and attached drawings are within the scope of protection of the patent right.

What is claimed is:

1. A blade withdrawal mechanism of a printer comprising:

a main body;

an installing support having a lower end pivotally attached to the main body;

a down-cut blade including a fixing board having a lower end pivotally attached to the installing support;

a balance unit attached to the installing support, and configured to pivot the down-cut blade and the fixing board between a normal state and a withdrawn state;

a locking unit configured to transition the installing support between a locked state, in which the installing support is locked from pivoting relative to the main body, and an open state, in which the installing support is configured to pivot relative to the main body; and a manipulation unit attached to the installing support and configured to move between a first segment travel and a second segment travel, wherein the manipulation unit drives the balance unit to transition the down-cut blade and the fixing board from the normal state to the withdrawn state when moved to the first segment travel, and the manipulation unit transitions the locking unit from the locked state to the open state when moved to the second segment travel.

2. The blade withdrawal mechanism of the printer according to claim 1, wherein:

the manipulation unit comprises a main part, which is configured to move between a top position and lowered position relative to the install support, and a flexible assembly which biases the main part in the top position, the main part including a handle, a first matching part for cooperating with the balance unit, and a second matching part for cooperating with the locking unit.

3. The blade withdrawal mechanism of the printer according to claim 2, wherein:

the first matching part of the manipulation unit comprises a vertically extended chute which is set at a top side of the main part, and a first stop dog; and the second matching part comprises a second stop dog which is set under the first stop dog.

4. The blade withdrawal mechanism of the printer according to claim 1, wherein:

the balance unit comprises a camshaft that engages the combination of the fixing board and the down-cut blade, and a cam including a pivoting head attached to an end of the camshaft, the balance unit cooperates with the manipulation unit through the cam.

5. The blade withdrawal mechanism of the printer according to claim 4, wherein:

the balance unit also comprises a flexible assembly which is positioned on a front side of the fixing board and the down-cut blade, and is configured to bias the fixing board and the down-cut blade toward the cam.

6. The blade withdrawal mechanism of the printer according to claim 4, wherein:

the balance unit comprises a stop block which is set at a rear side of the fixing board and the down-cut blade, the stop block configured to limit a rotation angle of the camshaft.

7. The blade withdrawal mechanism of the printer according to claim 4, wherein:

camshaft includes a smooth cutting face formed on a cylinder; and the balancing unit positions the combination of the fixing board and the down-cut blade in the normal state when the cutting face is perpendicular to the combination of the fixing board and the down-cut blade.

8. The blade withdrawal mechanism of the printer according to claim 1 is characterized in that:

the locking unit comprises a slip sheet, a flexible assembly, and a stop dog;

the slip sheet is installed on the installing support and can move downward under the effect of external force;

the stop dog is installed on the main body and cooperates with the slip sheet; and the slip sheet is provided with a chute and a bonding jumper, and the locking unit cooperates with the manipulation unit through the slip sheet and the bonding jumper.

* * * * *